US005326293A

United States Patent [19]

Shishido et al.

[11] Patent Number: 5,326,293

[45] Date of Patent: Jul. 5, 1994

[54] MULTI-CYLINDER ENGINE STRUCTURE AND OUTBOARD ENGINE

[75] Inventors: Motoyoshi Shishido; Sadafumi Shidara; Koji Koishikawa; Hiroshi Yamamoto, all of Saitama, Japan

[73] Assignee: Honda Giken Kogyo Kabushiki Kaisha, Tokyo, Japan

[21] Appl. No.: 896,901

[22] Filed: Jun. 11, 1992

Related U.S. Application Data

[63] Continuation of Ser. No. 672,291, Mar. 20, 1991, abandoned.

[30] Foreign Application Priority Data

Mar. 22, 1990 [JP] Japan ..... 2-29237[U]
Mar. 22, 1990 [JP] Japan ..... 2-29238[U]

[51] Int. Cl.[5] ..... F02B 13/00

[52] U.S. Cl. ..... 440/76; 123/579; 123/580

[58] Field of Search ..... 440/76, 77, 84, 87, 440/88, 113, 900; 123/59 PC, 195 P, 195 C, 434, 579, 580, 581-584, 572, 573

[56] References Cited

U.S. PATENT DOCUMENTS

| | | | |
|---|---|---|---|
| 1,462,782 | 7/1923 | Barbarou | 123/580 |
| 1,791,490 | 2/1931 | Dilworth | 123/580 |
| 1,875,444 | 9/1932 | Hall | 123/580 |
| 2,556,463 | 6/1951 | Bicknell | 123/580 |
| 4,445,466 | 5/1984 | Zaita | 123/580 |
| 4,463,711 | 8/1984 | Yoshioka | 123/580 |
| 4,881,510 | 11/1989 | Etoh | 123/572 |
| 4,947,807 | 8/1990 | Flaig | 123/579 |
| 5,018,503 | 5/1991 | Hoshiba | 123/580 |
| 5,036,805 | 8/1991 | Yamamoto | 123/579 |

FOREIGN PATENT DOCUMENTS 4-1661 1/1992 Japan .

*Primary Examiner*—Matthew C. Graham
*Attorney, Agent, or Firm*—Armstrong, Westerman, Hattori, McLeland & Naughton

[57] ABSTRACT

A multi-cylinder engine structure includes a multi-cylinder engine body having a plurality of cylinders vertically arranged therein. A fuel feed system has a fuel pump connected to a plurality of carburetors disposed in a vertical arrangement sideways of the engine body in independent correspondence to the cylinders. The fuel pump is disposed below a lowermost one of the plurality of carburetors arranged vertically. An outboard engine including a case tiltably mounted at a stern. A multi-cylinder engine body is contained in the case. A fuel feed system supplies a fuel to a plurality of carburetors disposed in correspondence to the cylinders. A fuel filter is also provided. The fuel pump is disposed below a lowermost one of the plurality of carburetors arranged vertically and above the fuel filter in a tilted-down state of the case.

15 Claims, 4 Drawing Sheets

MULTI-CYLINDER ENGINE STRUCTURE AND OUTBOARD ENGINE

This application is a continuation of application Ser. No. 07/672,291 filed Mar. 20, 1991, now abandoned.

BACKGROUND OF THE INVENTION

Field of the Invention

The present invention generally relates to a) a multi-cylinder engine structure including a multi-cylinder engine body having a plurality of cylinders vertically arranged therein, and a fuel feed system having a fuel pump connected to a plurality of carburetors disposed in a vertical sideways arrangement sideways of the engine body in independent correspondence to the cylinders, and b) an outboard engine constructed with the multi-cylinder engine structure contained within a case attached to a stern.

Description of the Related Art

A multi-cylinder engine structure and an outboard engine are known and described in, for example, Japanese Patent Application Laid-Open Publication No. 26367/87.

A fuel vapor may be produced within a line, such as, a hose for conducting a fuel from the fuel pump to the plurality of carburetors, and if a vapor lock occurs due to the fuel vapor, the fuel is not smoothly supplied to the carburetors.

As described in Japanese Utility Model Application Laid-Open Publication No. 142563/89, a multi-carburetor which maybe used in some cases, has a plurality of carburetors operatively connected to one another through a link mechanism, and in such a case, if a cover, as a component for the case covering the engine body, collides against the link mechanism for the multi-carburetor during attachment or removal of the cover, or if an external force is applied to the cover inwardly and effected on the link mechanism, the link mechanism may be deformed; thereby, interfering with a synchronous operation of the multi-carburetor.

SUMMARY OF THE INVENTION

Accordingly, it is an object of the present invention to provide a multi-cylinder engine structure and an outboard engine, wherein the supply of fuel to the individual carburetors can be smoothly effected.

In order to achieve the above object, according to the present invention, a multi-cylinder engine structure is provided having a multi-cylinder engine body with a plurality of cylinders vertically arranged therein. A fuel feed system has a fuel pump connected to a plurality of carburetors disposed in a vertical arrangement sideways of the engine body in independent correspondence to the cylinders, wherein the fuel pump is disposed below a lowermost one of the plurality of carburetors arranged in the vertical arrangement.

In addition, according to the present invention, an outboard engine is provided having a case tiltably mounted at a stern. A multi-cylinder engine body is contained in the case and has a plurality of cylinders arranged vertically in a tilted-down state of the case. A plurality of carburetors are disposed sideways of the engine body within the case in correspondence to the individual cylinders. A fuel pump is connected to the carburetors and is disposed within the case. A fuel filter is connected to an inlet of the fuel pump and is disposed within the case. A fuel feed system has a connector mounted on the case to connect a fuel tank disposed outside the case to the filter, wherein the fuel pump is disposed below a lowermost one of the plurality of carburetors arranged vertically and above the fuel filter in a tilted-down state of the case.

Further, according to another aspect of the present invention, in the multi-cylinder engine structure, a stationary member disposed around a periphery of the multi-carburetor is provided with a protrusion which projects toward the case more than the multi-carburetor.

In the outboard engine, protector devices are fixedly mounted in the front and rear portions of the link mechanism and located closer to an inner surface than to the link mechanism in the tilted-down state of the case.

The above and other objects, features and advantages of this invention will become apparent from a reading of the following description of the preferred embodiments, taken in conjunction with the accompanying drawings.

BRIEF DESCRIPTION OF THE DRAWINGS

The drawings illustrate one embodiment of the present invention, wherein.

DESCRIPTION OF THE PREFERRED EMBODIMENT

Figure 1:
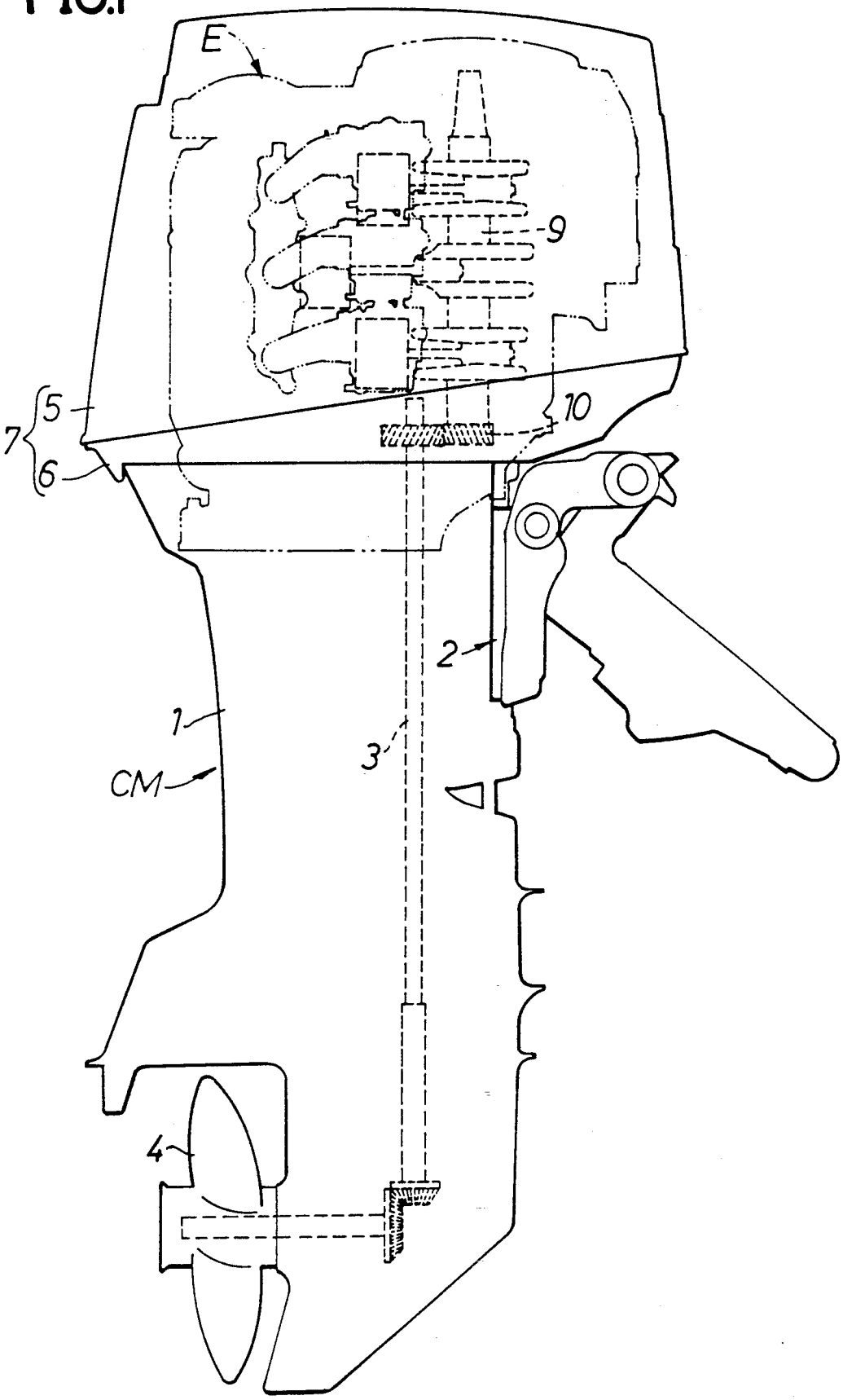
FIG. 1 is a side view of an outboard engine.

Referring first to FIG. 1, a casing 1 of an outboard engine structure is tiltably mounted on a stern plate of a hull (not shown) through a supporting means 2. A power from an engine E mounted on an upper portion of the casing 1 is transmitted through a driving force transmitting means 3 contained in the casing 1 to a propeller 4 carried on a lower portion of the casing 1. A case CM is formed by the casing 1 and a cover 7 connected to the upper end of the casing 1. The cover 7 includes a lower cover member 6 fixedly connected to the casing 1, and an upper cover member 5 detachably connected to the lower cover member 6. The engine E mounted on the casing 1 is contained in an engine room R defined in the cover 7.

Figure 2:
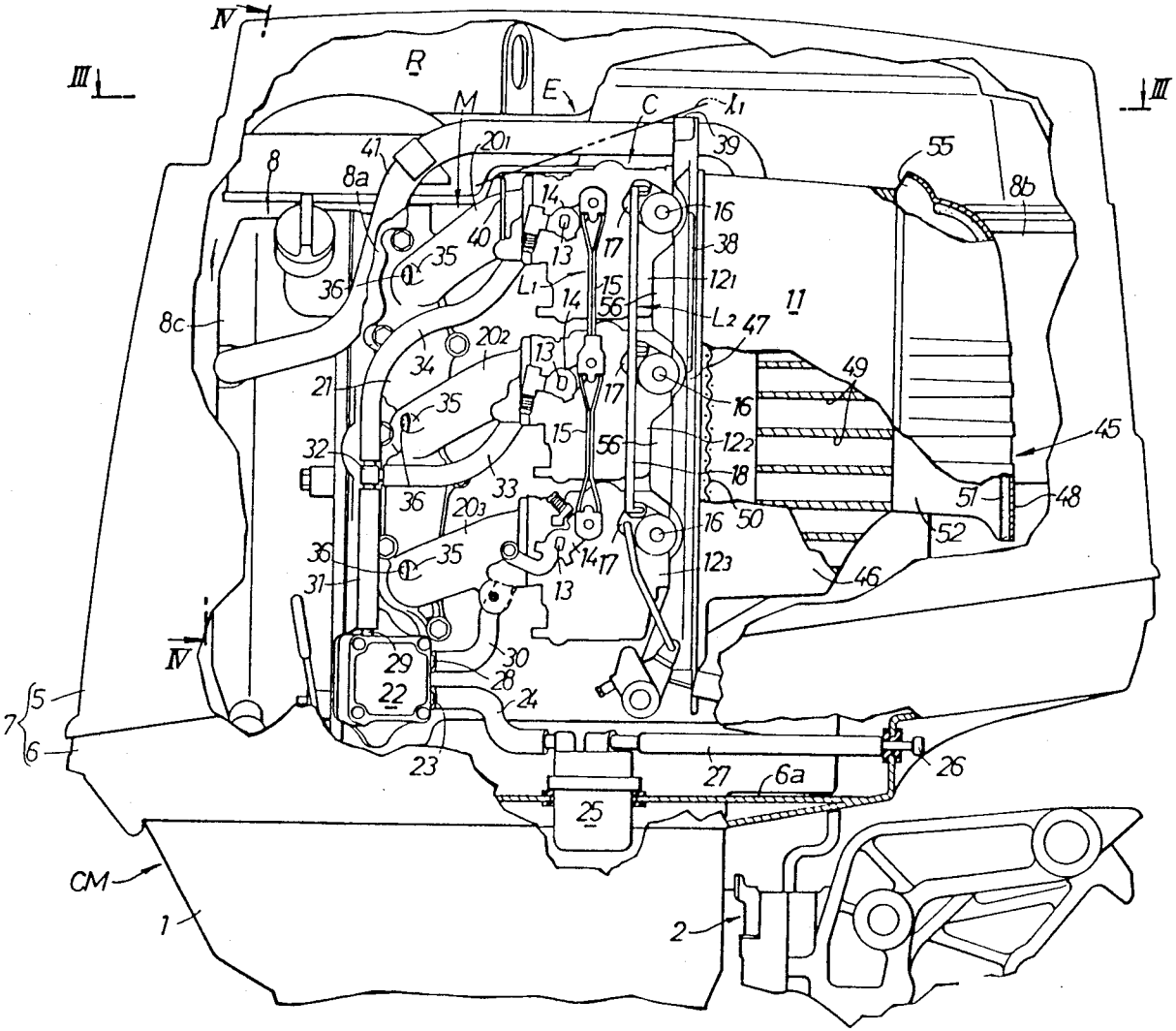
FIG. 2 is an enlarged vertical sectional side view of an essential portion shown in FIG. 1.

As illustrated in FIG. 2, the engine E is a vertical three-cylinder and four-cycle engine including a three-cylinder engine body 8 with cylinders vertically arranged in a tilted-down state of the case CM. The engine body 8 is mounted on the upper end of the casing 1 in a posture with its cylinder head 8*a* disposed on a rear side (on the left side as viewed in FIG. 2) and its crankcase 8*b* disposed on the front side (on a right side as viewed in FIG. 2) in a tilted-down state. As shown in FIG. 1, a vertical crankshaft 9 is connected to the driving-force transmitting means 3 through a gear mechanism 10.

An intake gas silencer box 11 is fixedly disposed sideways of the crankcase 8*b* in the engine body 8, and a multi-carburetor C is connected to the intake gas silencer box 11. More specifically, the multi-carburetor C includes three carburetors $\mathbf{12}_1$, $\mathbf{12}_2$ and $\mathbf{12}_3$ which independently correspond to the cylinders of the engine body 8 and are operatively connected to one another so that they are vertically arranged in the tilted-down state of the case CM. The carburetors $12_1$, $12_2$ and $12_3$ are commonly connected to the intake gas silencer 11. In the multi-carburetor C, the carburetors $12_1$, $12_2$ and $12_3$ have throttle valve stems 13 operatively interconnected through a first link mechanism $L_1$ which includes throttle levers 14 each connected to a corresponding one of the throttle valve stems 13, and connecting members 15 for connecting the adjacent throttle levers 14. The carburetors $12_1$, $12_2$ and $12_3$ also have choke valve stems 16 operatively interconnected through a second link mechanism $L_2$ which includes choke levers 17 each connected to corresponding one of the choke valve stems 16, and a link 18 for commonly connecting the choke levers 17 . Thus, the throttle lever 14 and the choke lever 17, of a lowermost carburetor $12_3$ of the carburetors 121, 122 and 123, are rotatively driven, so that the throttle levers 14 and the choke levers 17 of the remaining carburetors $12_1$ and $12_2$ are also interlockingly driven by the operation of the link mechanisms $L_1$ and $L_2$.

An intake manifold M is connected to the carburetors $12_1$, $12_2$ and $12_3$ in the multi-carburetor C. More specifically, the intake manifold M includes three intake pipes $20_1$, $20_2$ and $20_3$ independently corresponding to the cylinders in the engine body 8 and independently connected at end portions thereof to the carburetors $12_1$, $12_2$ and $12_3$, respectively. A common flange 21 is mounted at the other ends of the intake pipes $20_1$, $20_2$ and $20_3$ in the intake manifold M so that the carburetors $12_1$, $12_2$ and $12_3$ can be independently put into communication with combustion chambers (not shown) in the cylinders of the engine body 8 through the corresponding intake pipes $20_1$, $20_2$ and $20_3$, respectively.

The intake silencer box 11 includes a housing 45 which includes a passage member 46 for defining a plurality of intake passages 49 having axes parallel to intake paths of the carburetors $12_1$, $12_2$ and $12_3$ in the multi-carburetor C, and a flange 47 connected to an end portion of the passage member 46, and a guide cover 48 connected to the other end of the passage member 46. The multi-carburetor C is connected to the flange 47. Moreover, a net member 50 is placed on the side of the flange 47 within the passage member 46 for preventing the ingress of dust into the multi-carburetor C and for preventing the ingress of back fire into the passage member 46. An acoustic insulating material 51, such as, foamed urethane, is applied to an inner surface of the guide cover 48 which is provided at its lower portion with an air intake port 52 and at its upper portion with a vent hole 55 . The flange 47 is provided with projections 56 which protrude toward the link 18 between the choke valve stems 16 of the multi-carburetor C and permit the gap between the second link mechanism $L_2$ and the intake silencer box 11 to be set smaller.

Such an intake silencer box 11 permits intake noise produced in an intake stroke in the engine body 8 to be damped by way of a pipe length effect of each of the intake passages 49 and absorbed by the acoustic insulating material 51; thereby, providing a high silencing effect.

In the tilted-down state of the case CM, a fuel pump 22 driven by a cam shaft (not shown) is fixedly supported on the cylinder head **8*a*** below and rearwardly of the multi-carburetor means C; i.e., below the lowermost carburetor $12_3$ of the carburetors $12_1$, $12_2$ and $12_3$.

An inlet pipe 23 is mounted on the outer surface of the fuel pump 22 which faces toward the crankcase **8*b*, and a fuel filter 25 located forwardly (i.e., on the right side, as viewed in FIG. 2) of and below the fuel pump 22 in the tilted-down state of the case CM, is connected to the intake pipe 23 through a hose 24. A connecting pipe 26 projecting outwardly is fixedly supported on the lower cover member 6 of the cover 7, and connected to the fuel filter 25 through a hose 27. The fuel filter 25 is fixedly supported with its lower portion fitted into a bottom portion 6*a* of the lower cover member 6**.

A fuel tank (not shown) located outside the case CM is connected to the connecting pipe 26 so that the operation of the fuel pump 22 causes fuel pumped from the fuel tank to be introduced through the connecting pipe 26 and via the hose 27 into the fuel filter 25, and the fuel cleaned in the fuel filter 25 is drawn through the hose 24 and via the intake pipe 23 into the fuel pump 22.

The fuel pump 22 also includes a discharge pipe 28 mounted at its outer side directed to the crankcase **8*b* above the intake pipe 23, and a discharge pipe 29 mounted at its outer side directed upwardly. The discharge pipe 28 is connected to the carburetor $12_3$, while the other discharge pipe 29** is connected to the carburetors $12_1$ and $12_2$.

More specifically, the discharge pipe 28 is connected to the lowermost carburetor $12_3$ through a hose 30 extending forwardly from the fuel pump 22 . A hose 31 extending vertically is connected to the other discharge pipe 29 at its lower end, and an upper end portion of the hose 31 is connected to a three-way connecting member 32 which is disposed to substantially correspond with an intermediate location between the central carburetor $12_2$ and the lowermost carburetor $12_3$ of the vertically disposed carburetors $12_1$, $12_2$ and $12_3$. The connecting member 32 and the carburetor $12_2$ are connected to each other through a hose 33 , and the connecting member 32 and the uppermost carburetor $12_1$ are connected to each other through a hose 34. With such a connecting structure, all the directions of flow of the fuel from the fuel pump 22 toward the carburetors $12_1$, $12_2$ and $12_3$ are in the upward direction.

It is noted that it is necessary to confirm the intake pressure within each of the intake pipes $20_1$, $20_2$ and $20_3$ in the intake manifold M when the carburetors $12_1$, $12_2$ and $12_3$ of the multi-carburetor means C are synchronously adjusted. To this end, a boss 35, to which an adapter for detecting the intake pressure is connected, at an intermediate portion of each of the intake pipes $20_1$, $20_2$ and $20_3$ in the intake manifold M, and a threaded plug 36 is detachably and threadedly engaged with the boss 35. In order to facilitate connection of each of the adapters and detachment of the threaded plug 36 and to prevent the liquid fuel flowing along the bottom surface of the intake pipes $20_1$, $20_2$ and $20_3$ from entering the adapters, the bosses 35 are mounted on a sidewall opposite from the engine body 8 at vertically intermediate locations in longitudinally middle portions of the intake pipes $20_1$, $20_2$ and $20_3$, respectively.

Figure 3:
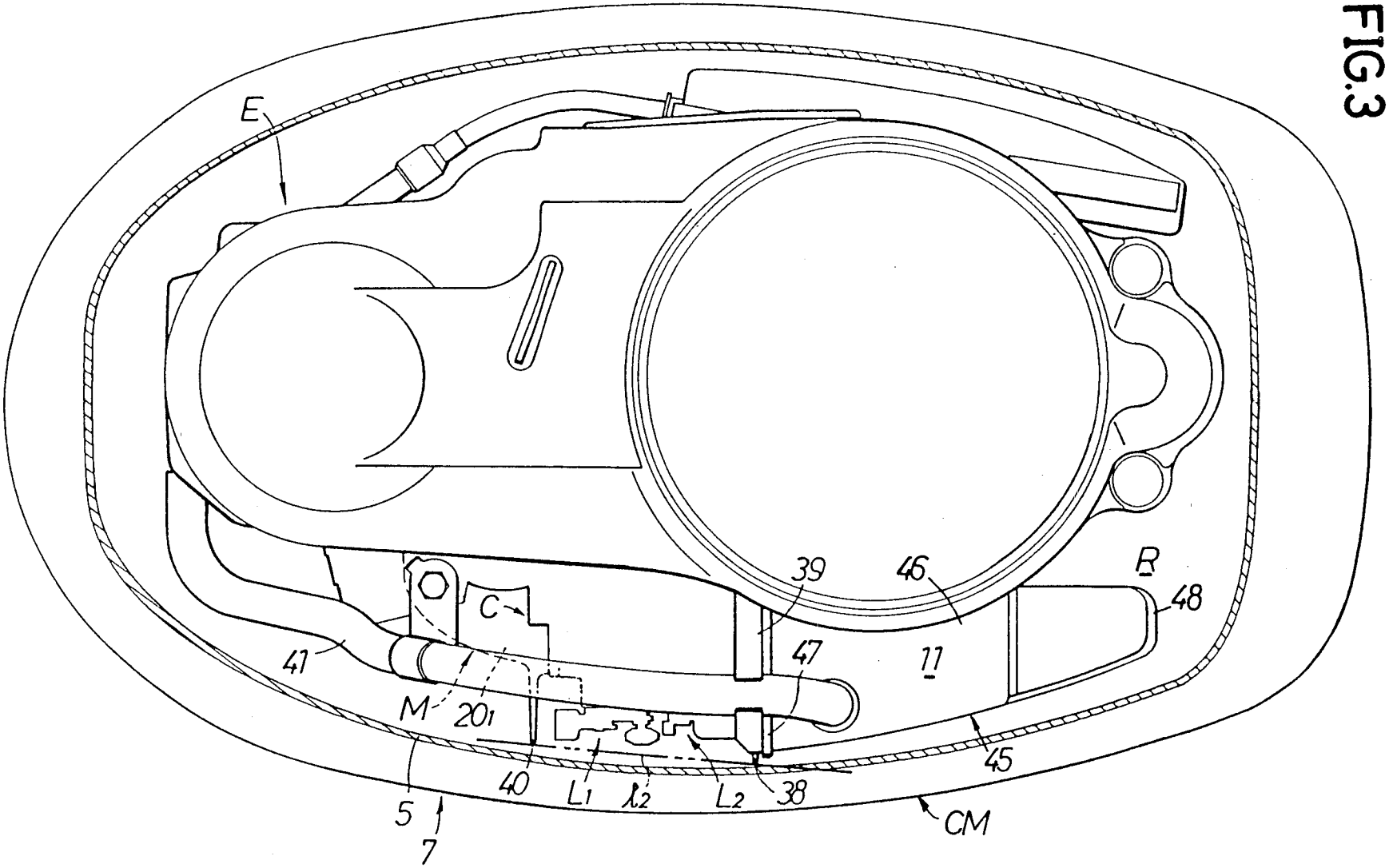
FIG. 3 is a sectional view taken along a line III—III in FIG. 2.
Figure 4:
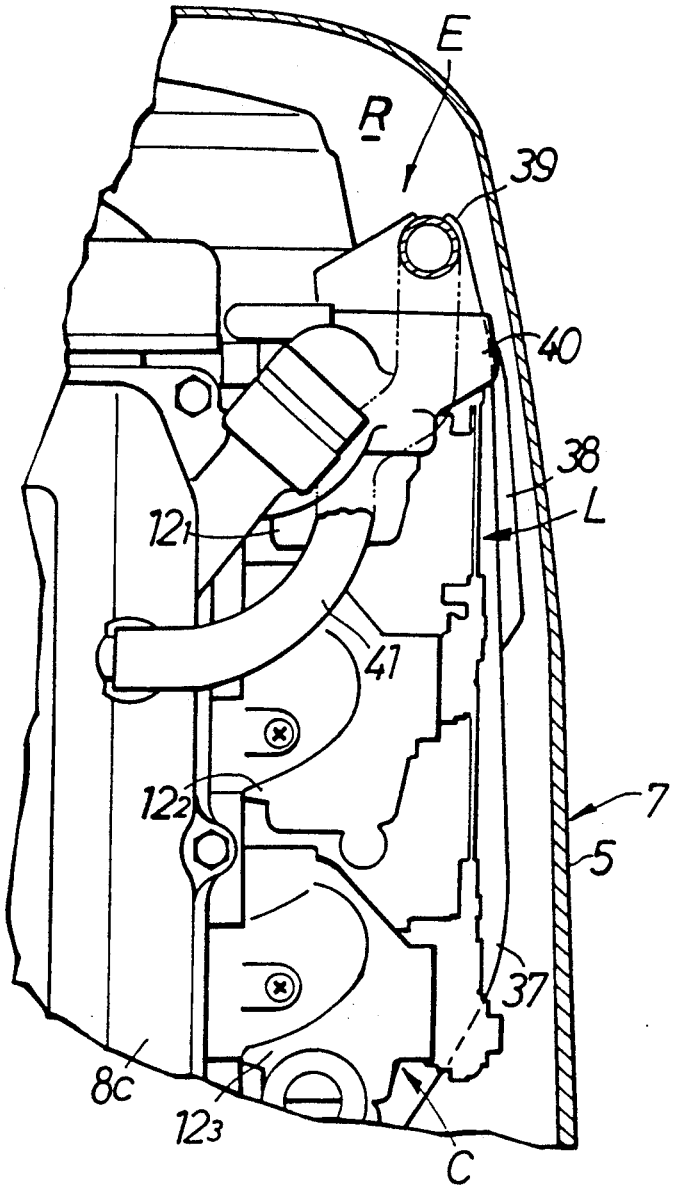
FIG. 4 is a sectional view taken along a line IV—IV in FIG. 2.

Referring to FIGS. 3 and 4, in order to avoid any malfunction of the first and second link mechanisms $L_1$ and $L_2$ for interlockingly operating the carburetors $12_1$, $12_2$ and $12_3$ of the multi-carburetor C due to contact of the cover 7 with the first and second link mechanisms $L_1$ and $L_2$ in the vertical type three-cylinder engine E, a stationary member located around the periphery of the multi-carburetor C within the engine room R; e.g., the flange 47 mounted on the intake silencer box 11 forwardly of the multi-carburetors means C, is provided, at a location corresponding to the carburetors $12_1$ and $12_2$ with a protrusion 38 serving as a protector and projecting sideways toward the cover 7, and is also provided with a protrusion 39 serving as a protector and projecting toward the cover 7 upwardly above the uppermost carburetor $12_1$. In addition, another stationary member located rearwardly of the multi-carburetor C; e.g., the intake pipe $20_1$ in the intake manifold M is provided with a protrusion 40 serving as a protector and projecting toward the cover 7 upwardly and sideways above the first and second link mechanisms $L_1$ and $L_2$.

A phantom line $l_1$ connecting leading ends of the protrusions 39 and 40 lies between the upper portion of the upper cover member 5 of the cover 7 and the first and second link mechanisms $L_1$ and $L_2$, and a phantom line $l_2$ connecting leading ends of the protrusions 38 and 40 lies between the side portion of the upper cover member 5 of the cover 7 and the first and second link mechanisms $L_1$ and $L_2$.

Moreover, the leading end of the protrusion 40 also functions to support an intermediate portion of a breather pipe 41 for conducting breather gas from the crankcase 8*b* of the engine body 8 to the head cover 8*c*.

The operation of this embodiment is described below. The fuel pump 22 has the pair of discharge pipes 28 and 29 for the carburetors $12_1$, $12_2$ and $12_3$ of the multi-carburetor C. Consequently, the variety of connecting pipings between the fuel pump 22 and the carburetors $12_1$, $12_2$ and $12_3$ is increased, as compared to a fuel pump having only a single discharge pipe. This structural arrangement contributes to an improvement in the balance of the flow rates of the fuel to the carburetors $12_1$, $12_2$ and $12_3$.

The fuel pump 22 located above the fuel filter 25 is disposed below the lowermost carburetor $12_3$ of the multi-carburetor C so that all the directions of flow of the fuel from the fuel filter 25 via the fuel pump 22 to the carburetors $12_1$, $12_2$ and $12_3$ can be upward. Therefore, even if a vapor of the fuel is produced within the hoses 24, 30, 31, 33 and 34 for conducting the fuel from the fuel filter 25 via the fuel pump 22 to the carburetors $12_1$, $12_2$ and $12_3$, the vapor of the fuel is smoothly led to the carburetors $12_1$, $12_2$ and $12_3$ and hence, the vapor lock phenomenon can be reliably prevented from being produced in the hoses 24 , 30, 31, 33 and 34; thereby, realizing a smooth supply of the fuel.

Further, the fuel filter 25 is supported on the bottom portion 6*a* of the lower cover portion 6; and hence, when the upper cover member 5 is removed for maintenance of the engine E, the maintenance of the fuel filter 25 can also be simultaneously conducted.

Moreover, the protrusions 38 and 39 provided on the flange 47 located at a fixed position around the periphery of the first and second link mechanisms $L_1$ and $L_2$ of the multi-carburetor C, and the protrusion 40 provided on the intake pipe 201 are disposed so that the phantom line $l_1$ connecting the leading ends of the protrusions 39 and 40 lies between the upper portion of the upper cover member 5 and the first and second link mechanisms $L_1$and $L_2$; and the phantom line $l_2$ connecting the leading ends of the protrusions 38 and 40 lies between the side portion of the upper cover member 5 and the first and second link mechanisms $L_1$ and $L_2$. This structural arrangement ensures that the contact of the cover 7 with the first and second link mechanisms $L_1$ and $L_2$ can be avoided to the utmost, even if an external force is applied to the cover 7 to inwardly deflect the latter, and the first and second link mechanisms $L_1$ and $L_2$ can be prevented from being deformed due to the contact thereof with the cover 7.

Although the example applied to the three-cylinder vertical engine has been described in the above embodiment, it will be understood that the present invention is not limited to the three-cylinder type and is widely applicable to a vertical multi-cylinder engine, as well as an outboard engine structure using the multi-cylinder engine.

The above description is included to illustrate the operation of the preferred embodiments and is not meant to limit the scope of this invention. The scope of this invention is to be limited only by the following claims. From the above discussion, many variations are apparent to one skilled in the art which would yet be encompassed by the spirit and scope of this invention.

What is claimed is:

1. An outboard engine comprising:

a case means tiltably mounted at a stern;

a multi-cylinder engine body contained within the case means and having a plurality of cylinders arranged vertically in a tilted-down state of the case means;

a plurality of carburetors disposed sideways of the engine body within the case means in correspondence with each of the cylinders;

a fuel pump connected to the carburetors and disposed within the case means;

a fuel filter connected to an inlet of the fuel pump and disposed within the case means; and a fuel feed system having a connecting means mounted on the case means for connecting a fuel tank disposed outside the case means to the filter, wherein the fuel pump is disposed below a lowermost one of the plurality of carburetors arranged vertically and above the fuel filter in a tilted-down state of the case means.

2. An outboard engine according to claim 1, wherein the fuel filter is disposed forwardly of the fuel pump in the tilted-down state of the case means.

3. An outboard engine according to claim 1 or 2, wherein the engine body is disposed within the case means with a cylinder head located rearwardly, in the tilted-down state of the case means, wherein the fuel pump is fixed to the engine body, and wherein the fuel filter is fixed to the case means.

4. An outboard engine according to claim 1, wherein the fuel pump is rearwardly disposed of the plurality of carburetors in the tilted-down state of the case means and connected to the plurality of carburetors through a plurality of discharge pipes, wherein at least one is mounted to extend upwardly from the fuel pump.

5. An outboard engine according to claim 4, wherein at least one of the plurality of discharge pipes is connected to the carburetor other than the lowermost one of the plurality of carburetors in the tilted-down state of the case means.

6. An outboard engine according to claim 5, wherein at least one of the remaining discharge pipes is mounted to extend forwardly from the fuel pump in the tilted-down state of the case means and connected to the lowermost carburetor.

7. An outboard engine comprising:

a case means mounted at a stern and having a cover detachably mounted thereon to define an engine room;

a multi-cylinder engine body contained in the engine room and having a plurality of cylinders arranged vertically in the tilted-down state of the case means; and a fuel feed system having a multi-carburetor means which comprises a plurality of carburetors disposed sideways of the engine body within the engine room in correspondence to the individual cylinders and operatively connected to one another through a link mechanism, wherein protecting means are fixedly mounted in front and rear portions of the link mechanism and located closer to an inner surface of the case than to the link mechanism in the tilted-down state of the case means.

8. An outboard engine according to claim 7, wherein a phantom line connecting the protecting means in the front and rear portions of the link mechanism lies above or outside the link mechanism.

9. An outboard engine according to any one of claims 7 or 8, wherein the fuel feed system comprises an intake silencer box commonly connected to the plurality of carburetors, and a pipe for connecting each of the carburetors to the engine body, and wherein the protecting means are provided on at least one of the pipe and the intake silencer box.

10. A multi-cylinder engine structure comprising:

a case means having a cover detachably mounted thereon to define an engine room;

a multi-cylinder engine body having a plurality of cylinders mounted in a vertical arrangement and contained in the engine room; and a fuel feed system having a multi-carburetor means which comprises a plurality of carburetors disposed sideways of the engine body within the engine room in correspondence to the individual cylinders and operatively connected to one another through a link mechanism, wherein a stationary member disposed around a periphery of the multi-carburetor means within the engine room is provided with a protecting protrusion which projects toward the case means more than the link mechanism for the multi-carburetor means at least around an upper portion of the link mechanism.

11. A multi-cylinder engine structure comprising:

a multi-cylinder engine body having at least three cylinders vertically arranged therein; and a fuel feed system having a fuel pump connected to a plurality of carburetors which are in a vertical arrangement sideways of the engine body in independent correspondence to the cylinder, wherein each of the carburetors is connected to a cylinder head of the engine body via an intake manifold, the fuel pump having a pair of discharge pipes, said fuel pump being fixed to the cylinder head at a location below a lowermost one of the carburetors, the lowermost one of the carburetors being connected to one of the discharge pipes while remaining carburetors are connected to the other discharge pipe via diverging means, and wherein the vertically arranged carburetors, intake manifold and fuel pump are accommodated within a narrow space defined between a casing means and a lateral side of the engine body.

12. An outboard engine comprising:

a case means mounted at a stern for defining an engine room;

a multi-cylinder engine body contained within the engine room; and a fuel feed system disposed within the engine room and having a plurality of carburetors disposed sideways of the engine body in correspondence to a plurality of cylinders, a fuel pump connected to each of the carburetors, and a fuel filter connected to an inlet of the fuel pump, wherein the case means includes a mounting portion fixed to the stern for defining a part of the engine room so as to contain at least a lower portion of the engine body, and a cover attached to the mounting portion such that the cover can be opened and closed, the cover defining a remaining part of the engine room;

the fuel pump being disposed below a lowermost one of the plurality of carburetors and the fuel filter being mounted on the mounting portion of the case means so as to be located below the fuel pump.

13. An outboard engine according to claim 12, wherein the engine body is disposed within the engine room so as to have the plurality of cylinders vertically arranged, and the plurality of carburetors being disposed in a vertical arrangement.

14. An outboard engine comprising:

at least three carburetors disposed in an engine room; and a pair of discharge pipes provided in a fuel pump, one of the discharge pipes being connected to a lowermost one of the carburetors that is located above the fuel pump, and the other of the discharge pipes connected to other two of the carburetors via diverging means.

15. A multi-cylinder engine structure comprising:

a multi-cylinder engine body having at least three cylinders vertically arranged therein;

a fuel feed system having a fuel pump connected to a plurality of carburetors which are in a vertical arrangement sideways of the engine body in independent correspondence to the cylinder; and a fuel filter disposed below the fuel pump and connected to an inlet of the fuel pump, wherein each of the carburetors is connected to a cylinder head of the engine body via an intake manifold, the fuel pump having a pair of discharge pipes, said fuel pump being fixed to the cylinder head at a location below a lowermost one of the carburetors, and the lowermost one of the carburetors being connected to one of the discharge pipes while remaining carburetors are connected to the other discharge pipe via diverging means.

* * * * *